US008177448B2

(12) United States Patent
Rolion et al.

(10) Patent No.: US 8,177,448 B2
(45) Date of Patent: May 15, 2012

(54) WRITING IMPLEMENT HAVING A CAPILLARY WRITING TIP

(75) Inventors: Franck Rolion, Asnieres sur Oise (FR); Arnaud Bez, Garches (FR)

(73) Assignee: Societe BIC, Clichy Cedex (FR)

( * ) Notice: Subject to any disclaimer, the term of this patent is extended or adjusted under 35 U.S.C. 154(b) by 778 days.

(21) Appl. No.: 12/300,582

(22) PCT Filed: May 11, 2007

(86) PCT No.: PCT/FR2007/051253

§ 371 (c)(1),
(2), (4) Date: Nov. 12, 2008

(87) PCT Pub. No.: WO2007/132115

PCT Pub. Date: Nov. 22, 2007

(65) Prior Publication Data

US 2009/0226240 A1 Sep. 10, 2009

(30) Foreign Application Priority Data

May 12, 2006 (FR) ..... 06 04265

(51) Int. Cl.
*B43K 5/00* (2006.01)

(52) U.S. Cl. ..... 401/199; 401/198

(58) Field of Classification Search ..... 401/196, 401/198, 202, 221, 222, 223, 199
See application file for complete search history.

(56) References Cited

U.S. PATENT DOCUMENTS

| | | | | |
|---|---|---|---|---|
| 3,356,440 | A * | 12/1967 | Darst | 401/118 |
| 4,341,481 | A | 7/1982 | Wollensak | |
| 4,645,367 | A * | 2/1987 | Mutschler et al. | 401/199 |
| 5,454,658 | A | 10/1995 | Kato | |
| 6,336,762 | B1 * | 1/2002 | Oike | 401/198 |
| 6,474,887 | B2 * | 11/2002 | Ozu | 401/23 |
| 6,536,976 | B1 * | 3/2003 | Konose | 401/198 |

FOREIGN PATENT DOCUMENTS

| | | | |
|---|---|---|---|
| GB | 2 187 942 | | 9/1987 |
| GB | 2 187 942 | A * | 9/1987 |
| JP | 2002-255255 | | 9/2002 |
| JP | P2002-255255 | A * | 9/2002 |

OTHER PUBLICATIONS

International Search Report for International Application No. PCT/FR2007/051253, mailed Feb. 11, 2007.

* cited by examiner

*Primary Examiner* — Jason J Boeckmann
*Assistant Examiner* — Justin Jonaitis
(74) *Attorney, Agent, or Firm* — Jones Day

(57) ABSTRACT

A writing instrument that includes a barrel having a front end, a fluid reservoir compartment, and a longitudinal axis. The writing instrument further includes a head disposed at the front end of the barrel where the head has a front part with an opening and at least one rib having a peak; a capillary connector having a front portion, a main portion having a diameter, a rear portion having a diameter, and a radial shoulder, where the capillary connector extends from the front part of the head to the fluid reservoir compartment; and a ring substantially coaxial with the longitudinal axis and disposed at a distance from the opening in the front part of the head. At least one air passage is formed between the ring and the barrel and the at least on rib extends in a radial direction between the ring and the barrel.

19 Claims, 2 Drawing Sheets

FIG.1.
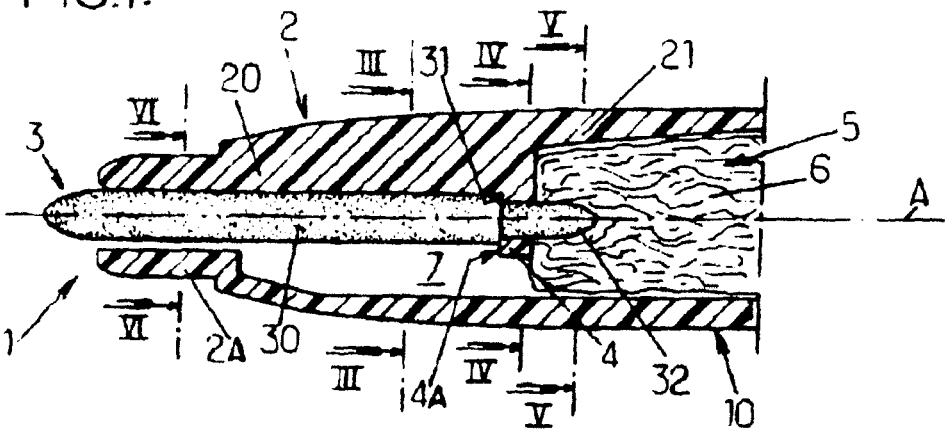
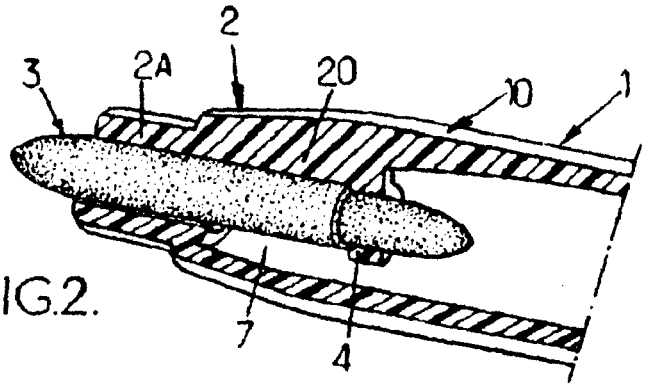
FIG.2.
FIG.3.
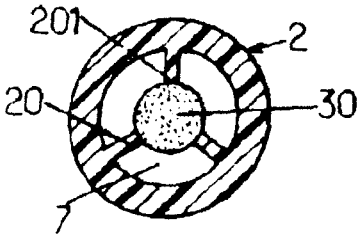
FIG.4.
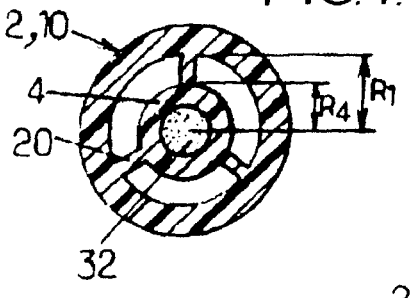
FIG.5.
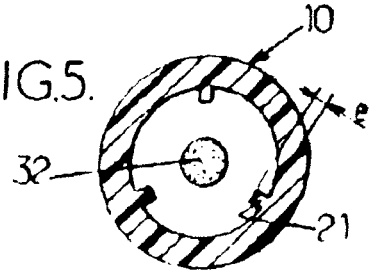
FIG.6.
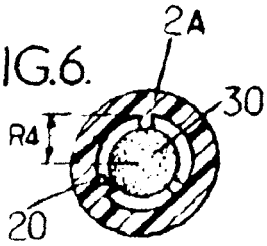

WRITING IMPLEMENT HAVING A CAPILLARY WRITING TIP

CROSS-REFERENCE TO RELATED APPLICATIONS

This application is a national stage application of International Application No. PCT/FR2007/051253, filed on May 11, 2007, which claims the benefit of French Patent Application No. 06 04265 filed on May 12, 2006, the entire contents of both applications being incorporated herein by reference.

BACKGROUND OF THE INVENTION

1. Field of the Invention

Embodiments of the present invention relate to a writing implement having a capillary writing tip, comprising:

- a barrel extending along a central axis and comprising a fluid-reservoir compartment,
- a tubular head situated at the front of the barrel with a front part having a front opening which has an internal cross-section smaller than the internal cross-section of the barrel, and comprising internal longitudinal ribs each having a peak, the peaks being capable of holding a capillary connector extending from the writing tip to the reservoir compartment substantially along the central axis, these ribs extending rearwards from the front opening of the head,
- a stop element capable of preventing a rearward axial movement of the capillary connector.

2. Description of Related Art

A writing implement of this type is known from U.S. Pat. No. 6,474,887 and is partially reproduced in the attached FIGS. 7 and 8. The implement 100 comprises a barrel 110, a head 102, a capillary connector 103, and a reservoir compartment 105 into which is inserted a plug 106 made from a fibrous material impregnated with fluid. A radial shoulder 131 of the writing tip abuts against the front end of the head 102 to prevent a rearward axial movement of the connector 103 in the event of an impact on the tip, in particular, if the front of the implement 100 rapidly strikes a surface. Four internal longitudinal ribs 120 extend to hold the connector 103, allowing an air passage between the front end of the head and the reservoir compartment 105.

Such a writing implement has various drawbacks. Firstly, the radial shoulder 131 rests only on the front ends of the ribs 120. As a result, the bearing surface is relatively small and does not guarantee that the tip will be firmly held at the end of axial travel if an impact occurs. The solutions consisting respectively of increasing the diameter of this radial shoulder 131 and/or increasing the number of ribs 120 would have the drawback of reducing the cross-section of the air passage between the tip 103 and the head 102.

SUMMARY OF THE INVENTION

The purpose of embodiments of the present invention is to remedy the above-discussed drawbacks by proposing a writing implement of the fluid applicator type that allows the writing tip to be firmly held axially in abutment in the event of an impact or excessive pressure on this tip.

To this end, an object of embodiments of the present invention is to provide a writing implement of the fluid applicator type as disclosed below, characterized in that a ring, substantially coaxial with the central axis and situated at a distance from the front opening of the head, is firmly attached to the barrel by the longitudinal ribs and forms the stop element by cooperating with the capillary connector, these ribs extend radially between the ring and the barrel, and in that the barrel, the head, the ribs and the ring are produced in a single moulded piece.

By placing the stop element at a distance from the front opening of the head, there is more space to form an air passage around this element. The ring-shaped stop element makes it possible for the capillary connector to rest axially on a broad solid surface. Furthermore, production as a single piece avoids any risk of disassembly and thus guarantees the solidity or rigidness of the stop element. Moreover, such a single-piece production has advantages in terms of simplicity of the production process, which can represent a significant cost reduction for mass production.

Preferably, the ring has a longitudinal front face inscribed within the cross-section of the front opening of the head, and the radially internal wall of the head is tapered towards the rear. It is thus possible to carry out the moulding of the barrel, the head, the ribs and the ring in a two-part mould with two cores, moveable in opposite directions in relation to each other along the central axis. A first core defines at least the opening of the head, the peak part of each rib, and the longitudinal front face of the ring, and can be in the shape of a cylindrical barrel having the same diameter as the external diameter of the ring. Longitudinal grooves are then provided in the cylindrical wall of this core to form the ribs. A second core defines at least the internal wall of the barrel and the greater part of the head, the base of the ribs, the rear longitudinal face of the ring, and preferably, the external radial wall of the ring. The internal radial wall of the ring can itself be defined by either of the two cores. The fact that the radially internal wall of the head is tapered towards the rear makes the removal of the second core easier.

In embodiments of the writing implement according to the present invention, one or more of the following arrangements is used:

- the ring is substantially circular and is coaxial with the central axis,
- the external radius of the ring is equal to the radius of the radially internal wall of the front part of the head,
- the external radius of the ring is comprised between half and three quarters of the internal radius of the barrel at the level of the ring,
- the longitudinal ribs are extended in the reservoir compartment by secondary ribs, the height of which is less than a quarter of the internal radius of the barrel,
- the writing implement comprises three longitudinal ribs distributed at 120°.

BRIEF DESCRIPTION OF THE DRAWINGS

Other characteristics and advantages will become apparent from the following description of non-limitative example embodiments, with reference to the Figures in which:

FIG. 1 diagrammatically shows a partial longitudinal sectional view of the front part of a writing implement, according to an embodiment of the present invention;

FIG. 2 diagrammatically shows a cutaway perspective view of the part of the writing implement shown in FIG. 1;

FIG. 3 diagrammatically shows a cross-sectional view of the writing implement in FIG. 1 taken along the line III-III;

FIG. 4 diagrammatically shows a cross-sectional view of the writing implement in FIG. 1 taken along the line IV-IV;

FIG. 5 diagrammatically shows a cross-sectional view of the writing implement in FIG. 1 taken along the line V-V;

FIG. 6 diagrammatically shows a cross-sectional view of the writing implement in FIG. 1 taken along the line VI-VI.

DESCRIPTION

Figure 7:
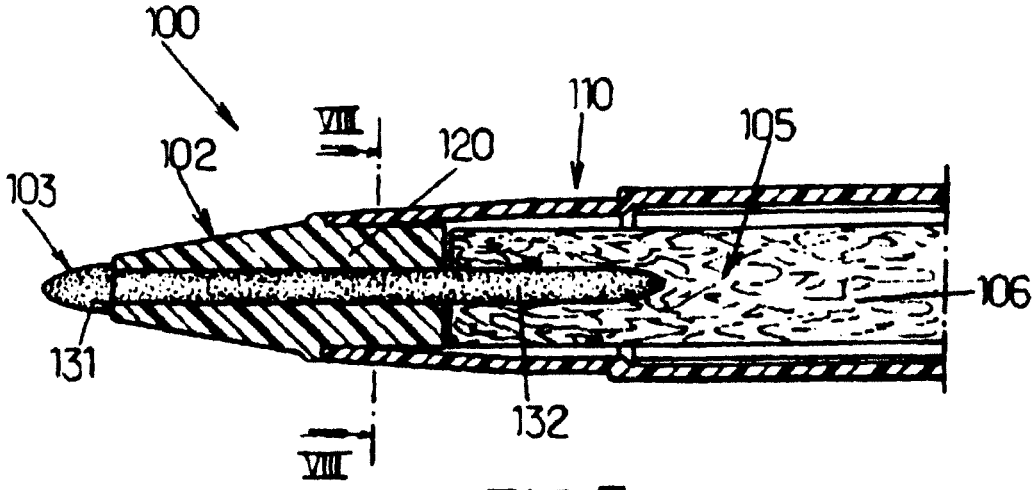
FIG.7. PRIOR ART
FIGS. 7 and 8 diagrammatically show a writing implement known from U.S. Pat. No. 6,474,887.
Figure 8:
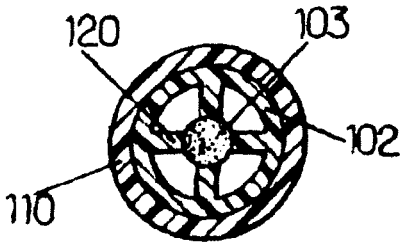
FIG 8 PRIOR ART

FIGS. 1 and 2 depict the same part of the writing implement and are described together. In FIG. 1, the writing implement 1 comprises a barrel 10 and a head 2 produced as a single moulded piece. The barrel 10 comprises a reservoir compartment 5 that contains an ink or a correction fluid. The ink is, for example, retained by capillarity in a plug 6. The writing tip of the instrument comprises the front end of an approximately cylindrical capillary connector 3 that is held along the central axis (A) by means of longitudinal ribs 20 moulded in the head 2. It is understood that the connector 3 could be formed from several capillary pieces placed end-to-end. The ribs 20 allow an air passage between the front end of the head 2 and the reservoir compartment 5, and extend towards the rear from the front opening of the head 2.

The greater part of the connector 3 is constituted by a main portion 30 that is essentially cylindrical, this main portion having a diameter slightly greater than the diameter of a rear portion 32 of the connector 3, in order to create a radial shoulder 31 distanced from the writing tip.

Three longitudinal ribs 20 are distributed at 120° about the central axis, and the peaks 201 of these ribs form three lines parallel to the axis (A) that define a cylindrical space of approximately the same diameter as the main portion 30 of the connector 3 for holding this connector radially as depicted in FIG. 3. Each rib 20 preferably comprises at its front end a flared shape to allow easier insertion of the connector 3 during assembly. Just to the rear of the radial shoulder 31 of the connector 3, at a distance from the front opening of the head, is a ring 4 having an internal diameter corresponding to the diameter of the rear portion 32 of the connector 3 to surround and make contact with a part of this rear portion 32 and form a stop element cooperating with the connector 3. The radial shoulder 31 of the connector 3 can thus rest axially on the broad solid surface of the ring 4. The ribs 20 connect the barrel 10 securely to the ring 4 by extending radially between the ring 4 and the barrel 10. Moreover, these ribs 20 extend longitudinally up to the level of the rear longitudinal face of the ring 4, and provision can be made for a relatively low height of each rib to be extended longitudinally towards the rear to form secondary ribs as explained below.

The ring 4, the ribs 20, the head 2 and the barrel 10 are produced as a single moulded piece. Thus, assembly of the writing implement consists essentially of installing the connector 3 in the head 2 of the writing implement and inserting the ink plug 6 into the rear opening of the barrel 10, not shown.

Advantageously, in particular, to increase the rigidity of the wall of the barrel in the zone of the reservoir compartment 5, the longitudinal ribs 20 can be extended in this compartment by secondary fibs 21, the height of which is less than a quarter of the internal radius of the barrel 10. Provision can be made for this height (e), as depicted in FIG. 5, to decrease progressively rearwards over all or part of the length of the secondary ribs 21. Another advantage of these secondary ribs 21 is to allow the ink plug 6 to be immobilized in the reservoir compartment 5 while leaving a degree of air passage between the plug 6 and the internal wall of the barrel 10, making it possible to avoid the creation at the rear of the reservoir compartment 5 of low air pressure, which would impede the circulation of the ink from the plug 6 to the connector 3.

The head 2 comprises a substantially tubular front part 2A, provided to receive a cap. At the rear of this tubular front part 2A, the void between the connector 3 and the internal wall of the head 2 becomes larger, as shown in FIG. 3, in comparison with FIG. 6. An empty compartment 7 open at its two axial extremities is thus created between each pair of ribs 20, and three empty compartments 7 are therefore distributed around the main portion 30 of the connector 3. The radially internal wall of the head 2 at the level of each compartment 7 is tapered towards the rear, so that it does not form a back draft for mould stripping.

In order to carry out moulding of the barrel, the head, the ribs and the ring 4 in a two-part mould with just two moveable cores, the ring 4 has a longitudinal front face 4A inscribed within the cross-section of the front opening of the head. With an approximately circular ring 4 and a tubular-shaped front part 2A of the head 2 having a circular cross-section as in the embodiment shown, this implies that the external radius R4 of the ring must be less than, or equal to, the internal radius of this front part 2A. This makes it possible for the void of each compartment 7 to be formed by a part of the first core and a part of the second core during moulding, these two core parts having a surface of mutual contact that is coaxial with the central axis (A) and which allows them to slide axially in opposite directions to each other when the cores are removed on stripping.

Preferably, the external radius R4 of the ring is equal to the internal radius of the front part 2A of the head. This makes it possible to produce a ring that is sufficiently thick for the solidity of the stop element, with an inner diameter sufficient so as not to compromise the cross-section for passage of the ink through the rear portion 32 of the connector 3.

Moreover, due to its radial thickness, the ring 4 contributes to the holding of the fibrous material of the plug 6 in the reservoir compartment 5 and to some extent, prevents a part of this fibrous material from moving forwards and entering the compartments 7 if the instrument 1 strikes a surface, which is advantageous in comparison with the known device depicted in FIG. 7.

The cross-sectional view of FIG. 4 taken along the line IV-IV in FIG. 1 illustrates an advantageous embodiment in which the external radius R4 of the ring 4 is between a half and three quarters of the internal radius R1 of the barrel 10 measured at the level of the ring 4. This choice is advantageous for reconciling both satisfactory retention of the plug 6 in the event of an impact and an adequate cross-section for the passage of air between the compartments 7 and the reservoir compartment 5. This radius R4 is moreover equal to the internal radius of the front part 2A of the head, as shown in FIG. 6.

FIG. 5 illustrates the fact that the height (e) of the secondary ribs 21 is less than a quarter of the internal radius of the barrel 10, to allow an adequate passage of air between the plug and the internal wall of the barrel but without excessively reducing the diameter of the plug in relation to the internal diameter of the barrel.

As shown in the cross-sectional view in FIG. 6, taken along the line VI-VI in FIG. 1, the height of each longitudinal rib 20 is relatively low in relation to the radius R4 of the main portion 30 of the connector, and the thickness of a rib is also relatively small. The height and thickness dimensions of a rib are intended to ensure an adequate cross-section for the passage of air in the front part 2A of the head without compromising the rigidity of the ribs for a firm radial hold on the connector

The invention claimed is:

1. A writing instrument comprising:

a barrel having a front end, a fluid reservoir compartment, and a longitudinal axis;

a head disposed at a front end of the barrel, the head having a front part with an opening and at least one internal longitudinal rib extending rewards from the opening;

a capillary connector having a front portion, a main portion having a diameter, a rear portion having a diameter, and a radial shoulder, wherein the capillary connector extends from the front part of the head to the fluid reservoir compartment, the at least one internal longitudinal rib designed to radially hold the capillary connector; and a ring substantially coaxial with the longitudinal axis and disposed at a distance from the opening in the front part of the head, the ring surrounding and contacting a part of the rear portion of the capillary connector, wherein at least one air passage is formed between the ring and the barrel, the ring having a front longitudinal face and a rear longitudinal face;

wherein the at least one internal longitudinal rib extends in a radial direction between the ring and the barrel and extends longitudinally to the rear longitudinal face of the ring.

2. The writing instrument according to claim 1, wherein the diameter of the main portion of the capillary connector is greater than the diameter of the rear portion of the capillary connector.

3. The writing instrument according to claim 1, wherein the radial shoulder of the capillary connector abuts the ring.

4. The writing instrument according to claim 1, wherein the ring has an internal diameter that corresponds to the diameter of the rear portion of the capillary connector.

5. The writing instrument according to claim 4, wherein a part of the rear portion of the capillary connector is inserted into the internal diameter of the ring.

6. The writing instrument according to claim 4, wherein the at least one rib further comprises a portion that extends into the reservoir compartment.

7. The writing instrument according to claim 1, wherein the barrel, the head, the at least one rib and the ring are an integral unit.

8. A writing implement having a capillary writing tip, the writing instrument comprising:

a barrel extending along a central axis and having an internal radius and a fluid reservoir compartment that houses an ink plug;

a capillary connector extending substantially along the central axis from the writing tip to the reservoir compartment, the capillary connector having a main portion with a diameter and a rear portion with a diameter, wherein the diameter of the main portion is greater than the diameter of a rear portion so as to create a radial shoulder at the junction between the front and rear portions of the capillary connector;

a tubular head located at a front end of the barrel, the tubular head having a front part with a front opening that has an internal cross-section smaller than the internal cross-section of the barrel and internal longitudinal ribs extending rearwards from the front opening of the tubular head, each rib having a peak, the peaks being designed to radially hold the capillary connector;

a stop element formed by a ring substantially coaxial to the central axis and located at a distance from the front opening of the tubular head and designed to cooperate with the radial shoulder of the capillary connector in order to prevent rearward axial movement of the capillary connector, the ring having a rear longitudinal face;

wherein the ring surrounds and contacts a part of the rear portion of the capillary connector, wherein the longitudinal ribs extend radially between the ring and the barrel and extend longitudinally to the rear longitudinal face of the ring, wherein an air passage is formed around the ring, and wherein the barrel, the head, the ribs and the ring are produced as a single moulded piece.

9. The writing implement according to claim 8, wherein the ring has a longitudinal front face inscribed within the cross-section of the front opening of the tubular head.

10. The writing implement according to claim 8, wherein the external radius of the ring is equal to the internal radius of the of the front part of the tubular head.

11. The writing implement according to claim 8, wherein the external radius of the ring is between half and three quarters of the internal radius of the barrel at the location of the ring.

12. The writing implement according to claim 8, wherein an internal wall of the tubular head is tapered towards the rear.

13. The writing implement according to claim 8, wherein the longitudinal ribs are extended into the reservoir compartment by secondary ribs, the height (e) of which is less than a quarter of the internal radius of the barrel.

14. The writing implement according to claim 8, wherein the ink plug comprises a fibrous material, and wherein the ring contributes to the holding of the fibrous material.

15. A writing instrument having a writing tip, the writing instrument comprising:

a barrel having an internal radius, a longitudinal axis, a front end, and a fluid reservoir compartment, wherein the barrel extends along the longitudinal axis;

a capillary connector extending along the longitudinal axis from the writing tip to the reservoir compartment, the capillary connector having a main portion with a diameter and a rear portion with a diameter, wherein the diameter of the main portion is greater than the diameter of a rear portion;

a head located at the front of the barrel, the head having a front part with a front opening and a plurality of ribs extending longitudinally rearward from the front opening of the head, each rib having a peak, wherein the peaks form an opening for holding the capillary connector; and a ring substantially coaxial with the longitudinal axis and located at a distance from the front opening of the head, the ring having an internal diameter that corresponds to the diameter of the rear portion of the capillary connector, the ring further having a rear longitudinal face;

wherein a portion of the rear portion of the capillary connector is inserted into the internal diameter of the ring, wherein the plurality of ribs extend radially from the ring to the barrel and extend longitudinally to the rear longitudinal face of the ring, wherein an air passage is formed around the ring, and wherein the barrel, the head, the ribs and the ring are an integral unit.

16. The writing instrument according to claim 15, wherein the capillary connector further comprises a radial shoulder at the junction between the front and rear portions of the capillary connector.

17. The writing instrument according to claim 15, wherein the barrel further comprises an ink plug.

18. The writing instrument according to claim 16, wherein the ring has a front longitudinal face and wherein the radial shoulder of the capillary connector abuts the front longitudinal face of the ring.

19. The writing instrument according to claim 15, wherein the plurality of ribs extends into the reservoir compartment.

* * * * *